United States Patent [19]

Haspert

[11] 4,280,732

[45] Jul. 28, 1981

[54] METHOD AND APPARATUS FOR MINING

[75] Inventor: John C. Haspert, Arcadia, Calif.

[73] Assignee: United States Pipe and Foundry Company, Birmingham, Ala. ; a part interest

[21] Appl. No.: 3,184

[22] Filed: Jan. 15, 1979

[51] Int. Cl.[3] ..... E21B 7/28; E21C 41/00

[52] U.S. Cl. ..... 299/11; 299/18; 299/31; 299/33; 299/56; 299/87; 299/90; 175/62; 175/171

[58] Field of Search ..... 299/1, 31, 33, 56, 50, 299/90, 87, 11, 18; 175/171, 53, 62, 394

[56] References Cited

U.S. PATENT DOCUMENTS

| | | | |
|---|---|---|---|
| 2,675,213 | 4/1954 | Poole et al. | 175/171 X |
| 2,839,271 | 6/1958 | Kandle | 175/394 X |
| 2,919,121 | 12/1959 | Ruth | 299/31 |
| 2,955,808 | 10/1960 | Kandle | 299/87 |
| 3,139,148 | 6/1964 | Robbins | 299/30 |
| 3,232,360 | 2/1966 | Dickinson | 175/171 |
| 3,672,726 | 6/1972 | House | 299/31 |
| 3,902,563 | 9/1975 | Dunn | 175/53 |
| 3,961,825 | 6/1976 | Lovat | 299/31 |
| 4,003,440 | 1/1977 | Cherrington | 175/53 |
| 4,043,136 | 8/1977 | Cherrington | 175/53 |
| 4,120,535 | 10/1978 | Delli-Gatti, Jr. | 299/87 |
| 4,156,471 | 5/1979 | Wagner | 175/394 |

*Primary Examiner*—William F. Pate, III

*Attorney, Agent, or Firm*—James W. Grace; Charles W. Vanecek

[57] ABSTRACT

A method of mining a mineral deposit from a remote point, particularly useful in mining pitching or horizontal seams, comprises boring, casing and preparing a log of a probe hole; the casing will later be used as a guide for the mining head. All personnel are remotely located from the mining face and the mining head follows the probe hole and is rotated by means of a novel drive stem powered from a portal based plant. Thrust is imparted to the rotating mining head in a non-cyclical manner by the intermittently supported drive stem. The mineral being mined is automatically removed from the face and discharged at the portal. Steel or reinforced concrete support collars follow the mining head and support the drive stem until the bore is mined out whereupon the collars, the drive stem and the guide are removed for reuse.

34 Claims, 11 Drawing Figures

Fig. 9
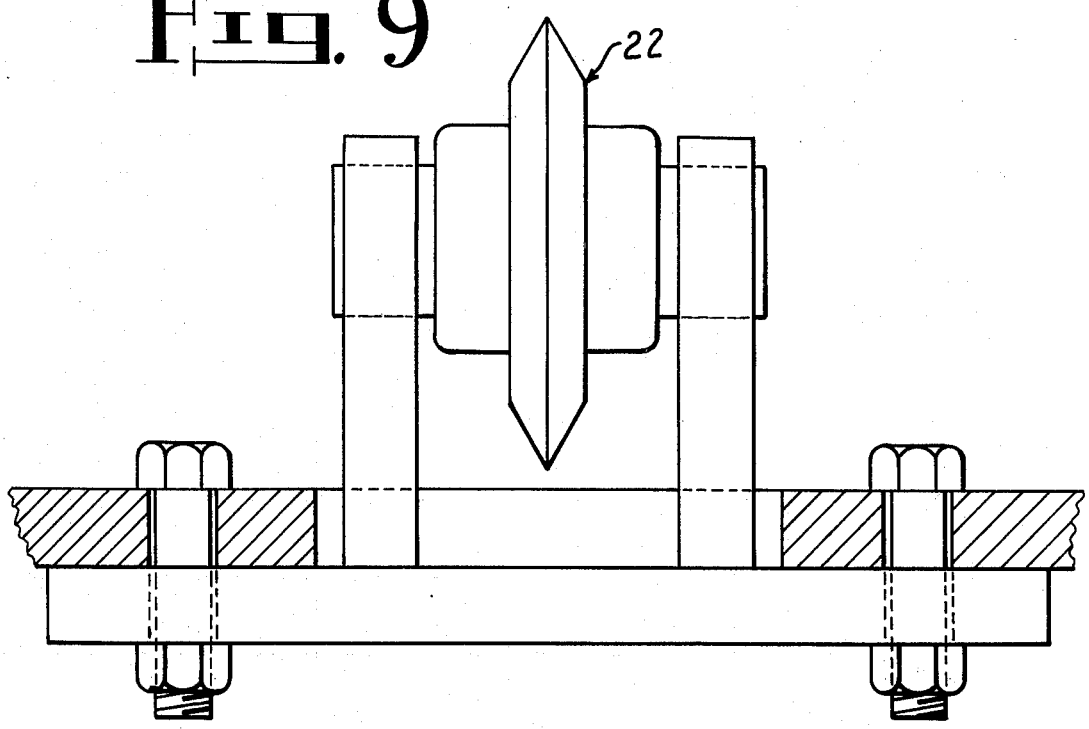
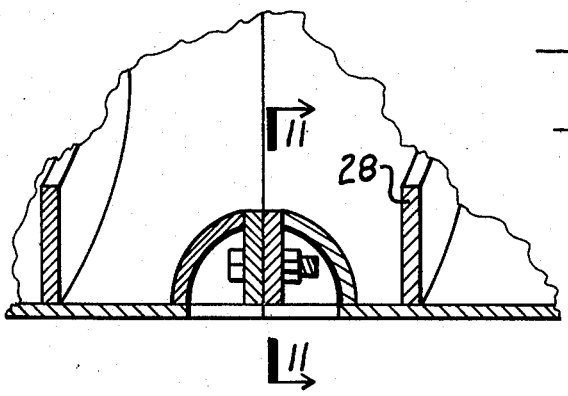
Fig. 10
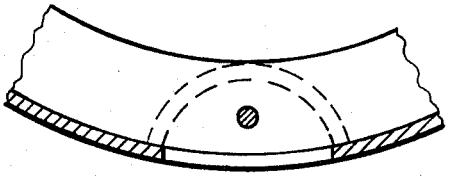
Fig. 11

METHOD AND APPARATUS FOR MINING

BACKGROUND OF THE INVENTION

This invention is in the field of mechanized or continuous mining or tunneling although other technologies such as directional drilling, gas removal and pipe jacking are relied upon. The invention relates more specifically to the field of continuous mechanized mining or tunneling wherein a rotating cutter is remotely controlled and moves in substantially a straight line with all extracted material being continuously removed. However, there are several important differences between the present invention and known mining or tunneling methods. For instance, tunneling proceeds from one predetermined point to another; however, the present method of mining can follow a mineral seam utilizing a guide member and at the same time supporting the entire bore with removable supports. It is, of course, the material being removed in a non-cyclical manner that is of primary concern and not the resulting bore.

Prior art patents issued to the inventor include U.S. Pat. Nos. 3,355,215; 3,399,738; 3,232,361; 3,678,694; 3,776,594; 3,778,107 and 3,411,826. While these inventions describe novel means of tunneling through the earth, neither these nor other methods known to the inventor provide a method for removing a desired material from a horizontal or pitching seam of great length without necessity of having miners at the face being mined. The well-known horizontal augering method is practical for only a few hundred feet, after which the auger becomes overstressed due to the friction between the auger flights and the bore as well as between the loose material and the bore. This friction limits the diameter as well as the length of bore in which the auger may be utilized.

Also, augering can only be accomplished in a straight line while the method of the present invention utilizes directional control. One of the more difficult seams to be mined is a seam which pitches at an angle from the horizontal. Such seams often are inclined from the horizontal at 15 to 20 degrees or more. Conventional mining of such seams is expensive and for the most part uneconomical. The present invention provides a method which can be carried out from an outcrop or a beginning face wherein the bore follows the seam and no miners are needed at the face, and yet the material being mined is removed up the slope and the bore is supported until mining has been completed.

Furthermore, the present method is less damaging to the ecology and the environment than known mining methods and is capable of removing 80% of a given mineral deposit.

SUMMARY OF THE INVENTION

The invention comprises first boring a pilot hole through a seam and encasing the hole with a metal tube. Preferably, this hole is located halfway between the top and bottom of the mineral seam. To assure such location, the drill pipe digging out the pilot hole is turned up and down at specific intervals to check the extremities of the seam thickness. This drilling method (with direction control) is well-known and has been practiced for many years in the petroleum industry. Examples of the technique and equipment used for directional drilling are revealed in the Rotary Drilling Conference Transactions & Minutes of Rotary Drilling Committee, dated September, 1966, "Positive Displacement Downhole Mud Motor for More Effective Directional and Straight Hole Drilling" and published by Petroleum Division of ASME. The probe hole can also be used to determine if quantities of gas will be encountered during mining. The ultimate use of the probe hole will be in guiding a mining head having a rotating cutter through the seam. This can be accomplished by leaving the probe hole drill pipe (so called "drilling string") in the hole it drilled after the drilling operation is completed. The thus planted "drill string" or metal encasement thus becomes the guideline to the mining head of the mining equipment.

After the probe hole is completed, a foundation from which to begin mining should be set in the earth, and a support "collar" handling and mining head rotating mechanism is fixed thereto. A mining head drive stem or shaft is attached to the mining head and an initial anchor collar is set in place with the probe hole casing passing through a bushing in the mining head, and rotation is begun. The mining head, which has been placed on a directional course through the metal encasement guidance system, is energized rotationally, and with drilling thrust, by means of the drive stem and its portal or surface-based power plant. As the mining head rotates, an axial force is applied to the drive stem forcing the head forward and a bore results which is slightly larger in diameter than the collar.

The initial collar and subsequently installed collars are jacked into the bore, via known pipe jacking technology, and made to follow the mining head as it is advanced through the seam. The collars provide mine support and support for the drive stem or shaft and have end faces suited for the jacking operation. Both support collar and drive stem are made up of individual sections which can be connected together during the mining operation. In addition to driving the mining head, the drive stem further serves to transport the mined material from the mining head to the mine portal via internal flighting or automatic, material transporting means located within the drive stem. At predetermined intervals the collars are provided with anchoring means which may be used at times to grip the wall of the bore resulting from the mining operation. As mining proceeds down the seam, the subsequent collars are added and the combination drive shaft—conveyor is extended as are the lines powering the jacks and any water or gas removal piping. As the mining head rotates, the mineral face is cut by rotary cutters located on the mining head and resulting larger than desired mineral pieces are further broken by the rotary and drag cutters of the mining head. These pieces are, when sufficiently small, urged through a port in the mining head and conveyed up the flights of the combination drive stem—conveyor, which flights can advantageously have a helical screw type configuration. Larger pieces are reduced in size by being forced against the face by the mining head. Water may be furnished to the face if needed to prevent dust formation and sparking should gas be present. Should the mining operation extend through or below a water table, mining can continue. After the bore has been extended as far as practicable or to the extremity of the mineral seam, the collars are jacked out of the bore allowing the walls to be unsupported. Reuse of the collars is intended and is a definite advantage of the invention.

DESCRIPTION OF THE DRAWINGS

FIG. 9 is a sectional elevation of a rotary cutter taken along the lines 9—9 of FIG. 4.

FIG. 10 is a fragmented sectional elevation of a joint in the drive stem taken along lines 10—10.

FIG. 11 is a sectional elevation taken along the lines 11—11.

DETAILED DESCRIPTION OF THE INVENTION

Figure 1:
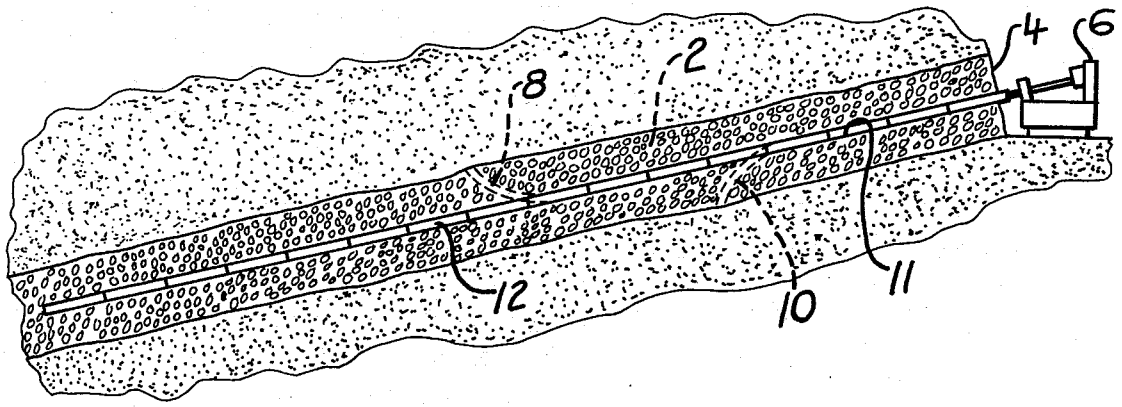
FIG. 1 is a cross sectional elevation view of a device drilling the pilot hole.

The present invention can be better understood by referring to the drawings. In FIG. 1, there is shown a mineral or ore deposit 2 pitching down from the horizontal with a face 4 which has been exposed. A machine 6 for drilling a probe hole 11 is located conveniently to face 4. Machines such as machine 6 are well-known to those skilled in the art of drilling oil wells and can be provided by an oil well supply company such as Smith International Inc. Such machines can perform directional drilling and a log of the formations encountered will reveal the direction as well as the upper and lower extremities of the mineral seam. Other valuable geological data also will be obtained from the drill log, such as gas content of the formation, strength of the materials encountered, ground water structures, and samples for chemical analysis. The direction of drilling is altered at desired intervals to check the extremities of the mineral seam such as at 8 and 10. By checking the location of the vertical extremities of the seam, the probe hole can be substantially centrally located in the seam for maximum recovery of the mineral during the subsequent mining operation. A metal encasement 12 of the probe hole 11 is completed, however, only in the direction that the mining head (later described) is to follow. This metal encasement is the metal drill pipe used to drive the probe hole drill and is put in place in a manner well-known to those skilled in the art. With the probe hole 11 complete, drilling machine 6 can be moved to commence drilling in another location. Since a series of adjacent bores are most desirable, machine 6 will be moved only a short distance.

Figure 2:
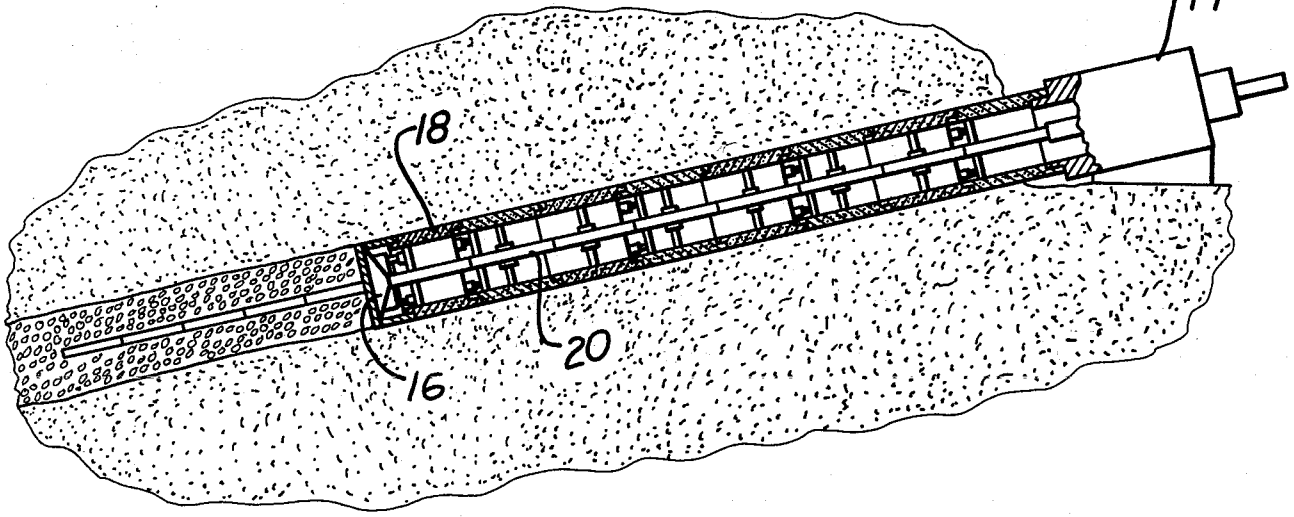
FIG. 2 is a cross sectional elevation view showing the preferred embodiment of the mining method.

Referring now to FIG. 2, there is shown a device 14 which provides means for handling the various components which will enter mineral deposit 2. This device 14 includes a boom crane for lifting and placing the equipment which will enter the bore. The boom crane is preferably hydraulically operated since device 14 also includes a hydraulic pumping and control unit to supply thrust for boring and jacking, as well as rotational power to rotate drive stem 20. Thrust for boring is imparted as an axial force to drive stem 20. Since device 14 provides axial thrust for the two separate systems of boring and jacking, it must be firmly anchored to the ground. Further equipment for use at the mine site would include a conveyance system to provide transfer for the mined mineral to a stockpile area, or to rail car loading.

A mining head 16 (see FIGS. 3 and 4), which includes a rotatable bulkhead 17 with entry ports 26, is properly aligned for boring into the mineral deposit, along with jacking collar 18 and drive stem 20 utilizing device 14. Jacking collar 18 is advantageously provided with anchoring means (not shown in FIG. 3) for gripping the wall of the seam (described below). The mining head is equipped with a bushing 34 through its diametrical center. The drill pipe 12 is made to pass through bushing 34 at the start of the mining operation at the portal. As the mining head advances in the mining operation, it remains engaged with the drill pipe and thus advances without going off course. The principal purpose of the mining head is to mine the mineral or ore at its heading in a rate controlled manner, and then to feed the mined material into an inner compartment behind the heading, from where the mined material can then be transferred to the portal through the drive stem or shaft.

Figure 3:
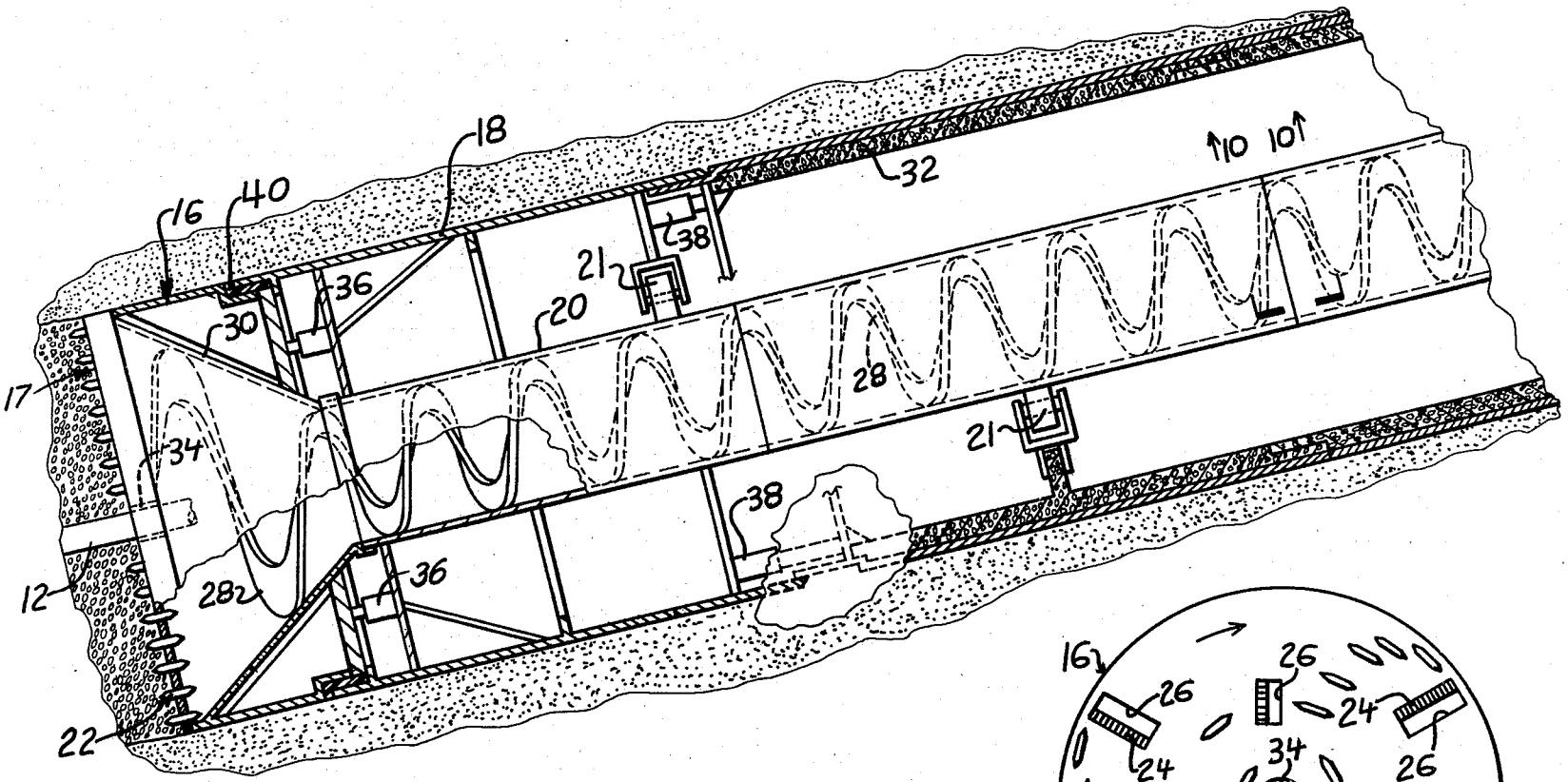
FIG. 3 is a cross sectional elevation of the mining head and means for connecting it to a collar.
Figure 4:
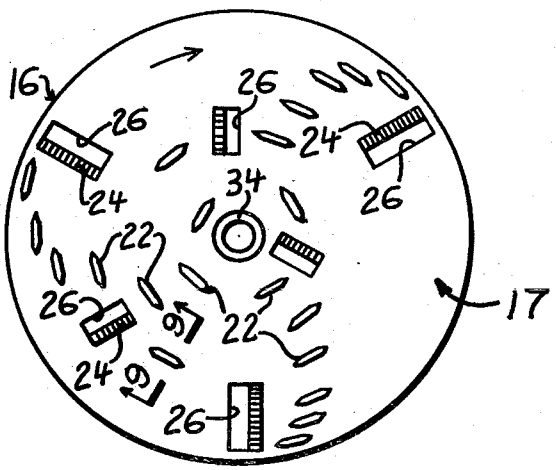
FIG. 4 is a front elevation view of the mining head.
Figure 8:
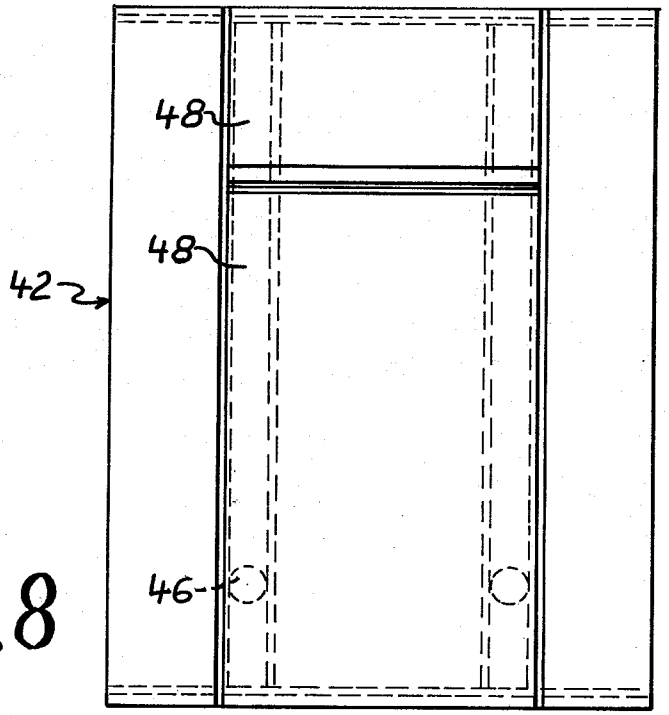
FIG. 8 is a side elevation of an anchor collar.

Various configurations are, of course, possible for the mining head as long as it's capable of achieving the above objectives. In most instances when a soft or low strength mineral or ore is being mined, the mining head will advantageously be provided with a bulkhead having entry ports which control the rate of loose material flow from the heading to the inner compartment. The bulkhead 17 of the mining head is also provided with cutting members, such as disc cutters 22, scalper teeth 24, or other conventional means for cutting through a formation. As can be seen in FIGS. 3 and 4, mining head 16 can be a generally hollow, cylindrical structure, with the bulkhead 17 for its front circular section and with portions of its rear circular section cut out to accommodate friction shoes 40 and to provide a centrally located, circular opening. The inner compartment of mining head 16 contains a frusto-conical shaped shell or flight housing 30, which has bulkhead 17 for its circular base and the apex portion cut off. The wall of flight housing 30 tapers rearward from bulkhead 17 and has flighting 28 (described below) welded to its inner surface. The circular aperture in the rear wall of mining head 16 provides an open channel from mining head 16 to drive stem 20 for flighting 28. The mining head should be constructed of material having sufficient strength to perform its mining operations, such as of metal, preferably steel.

Figure 7:
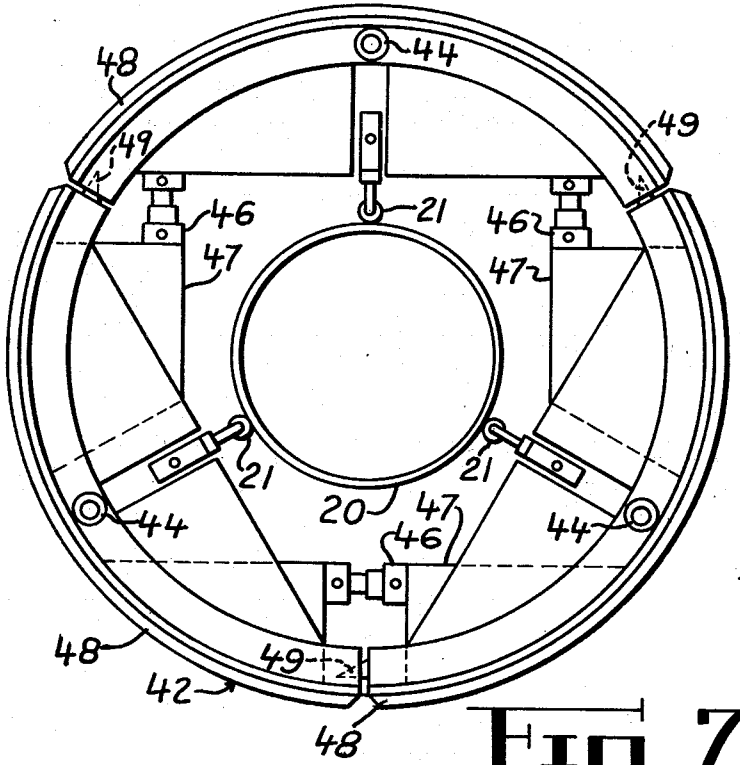
FIG. 7 is an end elevation of an anchor collar.

A unit of the drive stem 20 is conveniently attached by any suitable means, such as through a flange connection, to flight housing 30 at the rear of mining head 16. As shown in FIGS. 3 and 7, each drive stem unit can be in the shape of a pipe. Support for drive stem 20 is provided by collars (which are described below).

Once properly aligned, mining head 16 is rotated by rotating the drive stem 20. Rotation may be imparted to drive stem 20 by any conventional means, such as by a motor driven pinion gear meshed with a ring gear fitted around the drive shaft 20. Such means are well-known and, therefore, not shown. Mining head 16 is forced by drive stem 20 into the face of the mineral deposit. The disc cutters 22, (see FIGS. 3, 4, and 9), which are mounted on bulkhead 17, roll against the face being mined, cutting grooves into the face as mining head 16 rotates in the direction shown by the arrow in FIG. 4. These disc type cutters rotate utilizing sealed bearings and may be mounted in a random pattern on the rotatable bulkhead. When the grooves reach a certain depth, pieces of the mineral will begin to break off and/or scalper teeth 24, also located on bulkhead 17, will break off pieces of the mineral. These scalper teeth 24 are so arranged that they also serve to deflect the broken mineral into entry ports 26 in mining head 16. The entry ports 26 are sized so as to admit only particles of the mineral below certain predetermined dimensions and also so as not to allow more mineral to enter the mining head than can be carried up the drive stem 20 by flights 28. Entry ports 26 and scalper teeth 24 are preferably located ahead of cutters 22, affording some protection from damage by large pieces of mineral.

Drive stem 20 is composed of individual pipe-like units or joints, preferably made of a metal such as steel, which are suitably connected to each other. The drive stem may range in size depending on the mining bore diameter, as, for example, from two feet to over six feet in diameter and can be, for example, ten feet or longer in length. The drive stem can be flange connected. The joints are designed so that the end flanges permitting the connections, one joint to another, are in flush configuration on the outer diameter to conform with the outside diameter of the pipe. The individual joints are so joined together that they are centrally positioned within the mine support collars 18, 32. The assembled drive stem 20 is supported within the bore at regular intervals by stabilizer rollers 21, attached to the support collars and anchor collars. A number of these stabilizer rollers, as e.g. three such rollers, can conveniently be used in combination around the inner circumference of a given cross section of each support collar or anchor collar, with each roller equidistant or 120 degrees (in the case of three) from its neighboring rollers. One such roller is shown in collars 18, 32 of FIG. 3.

The drive stem receives its driving power from the portal or remote positioned power plant 14. Power plant 14 drives the drive stem and, through it, the mining head. The drive stem serves three distinct functions in the mining operation. It delivers rotational drive from the power plant (located at the surface) to the mining head. It delivers drilling thrust to the mining head and controls the desired rate of advance as the mining action at the mine heading transpires. The drilling thrust developed at the surface based power plant is transmitted through the drive stem to the mining head. The power plant 14 thus acts to rotate or push forward the drive stem at the mine surface and, since the mining head is connected to the other end of the drive stem at the face being mined, it is similarly made to rotate or advance forward.

The third function which the drive stem serves is to remove the mined material from the heading area by means of automatic material transporting means located within the drive stem. This is accomplished through internal flighting 28 which proceeds from the back of bulkhead 17 in the mining head through drive stem 20 to the mine portal. Flights 28 are formed by welding a continuous rectangular plate to flight housing 30 to form a screw type conveyor in the mining head. The tapered wall of frusto-conical shaped element 30 which extends rearward from bulkhead 17 serves as the housing for the internal flighting. A continuous rectangular plate is similarly welded to the inside of each of the units of drive stem 20. The frusto-conical shaped flight housing 30 of mining head 16 is then attached to a unit of drive stem 20 and each subsequently added unit of drive stem 20 is attached to the previously installed one in such a manner that the flights 28 form a continuous spiral flighting structure from mining head 16 to the mine portal. Flights 28 are made to protrude only a few inches from the surface to which they are welded, leaving the center of flight housing 30 and drive stem 20 open. It should be noted that, unlike most screw conveyors, the flights 28 rotate along with the flight housing 30 and drive stem 20. As the drive stem and thereby the mining head are made to rotate, the mined material passing into the mining head is "augered" or moved from the mine heading to the mine portal by means of the spiral flighting assembled to the inner compartment of the mining head and the internal flighting of the drive stem. During the mining, drill pipe 12 comes into contact with and rests on the mined material and the spiral flighting within the drive stem.

The internal flights are designed to generate particle movement in a direction opposite to the drive stem's advance with the mine heading as the stem rotates. Thus, for example, a counterclockwise rotation of the stem to the mining head would require the flight screw to be left handed to generate particle movement backward toward the power plant.

The flighting pitch and the chord height at its center can be readily established once the size of a mine bore, the declining angle (pitch) of the mine bore, should one exist, and the desired rate of rotation of the drive stem have been determined.

The mined materials' affinity for steel may complicate the process of transporting the material to the mine surface. This affinity for steel can be reduced by employing water as an additive. This can be accomplished by water injection at the portal side of the drive stem, and in controllable amounts, in the event the mining operation is in a totally dry or "problematic moist" geological environment. It is not expected that conditions of this nature will be encountered in the mining of minerals other than those in the clay family, or hydrocarbon minerals having a semi-solid consistency mixture with sand.

It should be noted that engineering flexibility exists with regard to rotation of the mining head by the drive stem, in that the drive stem and mining head can be rotated on a one to one basis, wherein each revolution of the drive stem delivers a complete revolution to the mining head, or wherein, through a planetary gearing system, the mining head will make only a fraction of a revolution to each full revolution of the drive stem.

It is expected that a one to one basis of mining head to drive stem rotation will satisfy mining operations with bores ranging to approximately 12 feet in diameter and declining up to approximately 10° from the horizontal. Bore diameters greater than this, or in this diameter range but declining at a steep pitch, can be mined and the material removed at a desirable rate by recourse to a planetary drive from drive stem to mining head. The planetary gear drive will allow ratios of one to one, one to three, one to four, etc. of mining head to drive stem, pending the design engineer's elective.

As mining head 16 advances into mineral deposit 2, support collars, which are preferably steel reinforced concrete collars, are made to follow it, via pipe jacking technology, commonly referred to as "inch-worming." The pipe jacking and inch-worming technique provides mine support as the mine heading advances, and permits removal of the support system after the mine's depth or length extension has been reached. As the means to the recovery of a mine's support system, it becomes the critical function to which the economy of the rest of the mining technique is anchored. The pipe jacking technique has support in proven performances experienced by the tunneling industry, with the exception, however, that as a tunnel driving technique, the support collars are never removed from the bore. Thus jacking a string of support collars has heretofore been in one direction only.

Mine support, synchronous with the heading advance, can be achieved through hydraulic jacking of circular steel or concrete collars extending from the mining head to the portal. They are hydraulically jacked forward in incremental units and the units in incremental stages. The support unit directly behind the mining head is advanced in concert with the advance of the mining head, and units of collars following the lead unit are advanced in cyclic stages.

Mine support collars for use in the mobile mine support system of the invention can have various forms, such as precast concrete pipes, single concrete cast collars contained within a steel shell, or they can be segmented (e.g. three units) assemblies, lug connected for drive pressure and bolt connected for ring assembly. The collars can vary in length, as e.g. from 10 to 20 feet.

Figure 6:
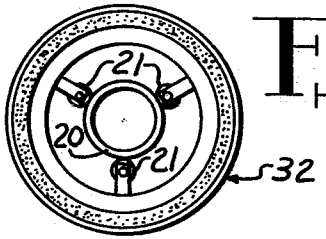
FIG. 6 is an end view of a concrete collar including three stabilizer rollers.

A typical support collar is comprised of concrete reinforced with a steel shell, the whole assembly in the shape of a cylindrical tube or pipe. The steel shell provides structural strength and a low friction component when the collar is pressured to forward or retreat movement. The ratio of steel to concrete depends on the ground formations, their strength, and the subsequent overburden pressures each mine site harbors. Each collar as a unit can advantageously have a structural support member near its center which would house a stabilizer type assembly, such as of rollers (see FIG. 6) which in turn confine drive stem 20 to the longitudinal and center axis of the mine bore.

Other design features of the mine support collars (not shown in the drawings) can include hanger provisions from which hydraulic lines and electric lines can be suspended, telescopic male and female ends to allow over-lap in the assembly process, and a "plugged pipe nipple" extending from the inner section of each collar section through to a flush mount with the outer steel section. The latter structural feature would provide a means for applying a lubricant (water or mud) to reduce skin friction in areas of a mine bore where high coefficients may develop because of the geological structure of the overburden or the basement material.

An analysis has been made of overburden pressures as they relate to bore diameters in various materials. Information is at hand which aid the support collar designer in determining the cross sectional area the support collar must have to withstand the collapsing pressures a given overburden would pose. The overburden pressure varies with the geology of a given mine site. It is therefore necessary for the designer to have available the geological data necessary to calculate the overburden pressure as it would exist with a given bore diameter and the earth formations at a given mine site, above and below the mineral or ore horizon.

Figure 5:
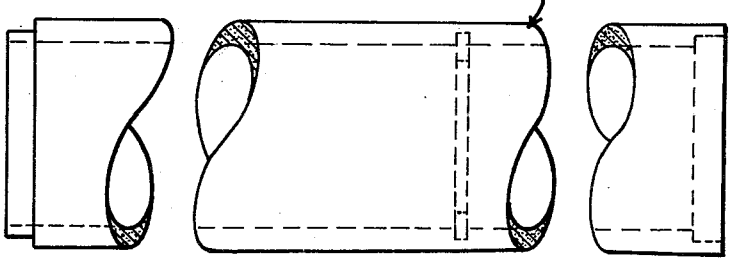
FIG. 5 is an elevation view of a concrete support collar.

After mining head 16 and the first placed support unit or jacking collar 18 behind it have been advanced a predetermined distance into mineral deposit 2, support collar 32 (see FIGS. 3, 5, and 6), along with a section of drive stem 20, is placed in axial alignment with jacking collar 18 by utilizing device 14 and the drive stem sections are connected as shown in FIGS. 10 and 11. Rotation of mining head 16 is continued and the axial force imparted by device 14 to drive stem 20 keeps cutters 22 forced against the face 4 of mineral deposit 2.

As mentioned above, jacking is accomplished using the "inch-worming technique" which is well-known in the art. Simply stated, one collar or a group of collars directly behind mining head 16 are jacked forward by pushing against the collars nearer the entrance. Subsequently, a second collar or group of collars are jacked forward, again by pushing against the collars nearer the entrance. This "inch worming" of incremental numbers of the collars into the bore continues in a cyclic manner as mining head 16 advances.

The directional alignment of mining head 16 is controlled by casing 12 of probe hole 11. This casing 12 passes through guide bushing 34 and assures that mining head 16 will follow pilot hole 11.

Since the axial force feeding mining head 16 into the mineral deposit is separate from the axial force which jacks the collars into the main bore, there is provided a system which insures that the collars will follow the mining head closely enough to prevent a gap from forming therebetween. This system includes load cells 36 (FIG. 3). The load cells, which are sensitive to pressure variations and positioned between the mining head and the "lead-unit" collars, provide the intelligence to the hydraulic circuitry which controls the cyclic jacking of all the other units of collars extending to the mine's portal. The technology provides the means through which a chain of collars extending several thousand feet in length can be moved into or out of a mine bore, without over stressing the ends of the collars.

The load cell is the intelligence developing unit which signals the sequential operating order between the drilling head and the movement of the mine support system. This includes, for example, during a mining operation the "signal" that mining is advancing at the desired pre-selected rate, and the command signals to the jacking stations, which cyclically move the increment units of mine support collars forward at a rate synchronous to the advance rate of the cutting head. In a retreat movement from a mined bore a similar function would initiate with the load cells.

The load cells 36 sense the pressure between mining head 16 and jacking collar 18. When a decrease in pressure is sensed, the load cells signal the hydraulic system (a part of device 14) to increase the thrust provided by thrust rams 38. These thrust rams 38 force jacking collar 18 to closely follow mining head 16. Thrust rams 38 can supply an axial force in either direction. To prevent metal to metal contact between mining head 16 and jacking collar 18 and to minimize friction between these two components, there is provided friction shoe 40.

Mine bores developed in mineral or ore seams pitching less than 10° from the horizontal would seldom require provisions for anchor hold on the bore walls in the recovery cycle of the mine support system. Mines developed in seams having a pitch angle greater than approximately 10° from the horizontal would, in most cases, require the mine support system to be able to wall anchor itself at select points. To achieve this anchoring effect, anchor collars or steel shells 42 (see FIG. 7) can be interspaced at certain intervals between concrete support collars 32, such as at a ratio of approximately one anchor collar to 10 support collars, said anchor collars being equipped with wall anchor shoes that grip the wall of the mine bore. This wall anchor system thus provides intermediate thrust bases to the inch-worming technique which permits jacking the support system back out of a mine bore.

Anchor collar 42 is similar to collar 32. It is suitably a fabricated steel assembly and is preferably a three-segmented unit, lug connected in a manner which allows the three segments to expand; that is, each of the segments can be thrust in an outward direction from the assembly's longitudinal axis. This action forces each segment against the bore wall. The force with which it engages the mine bore wall should be substantial enough to permit the thrust jacks or rams 44 (see below) housed on each end of the wall anchor assembly to exert end thrust pressure to the movement of the tandem assembly of the concrete mine support collars between it and the next wall anchor collar in the "string assembly." Anchoring to the mine wall must be used whenever the frictional force between the jacking station and the wall of the mine bore is insufficient to support the pushing force required to move the mine support system. Even sometimes in horizontal seams the frictional force might be so low that resort to wall anchoring of the mine support system at select points becomes necessary.

There is illustrated in FIG. 7 a typical anchor collar 42, which is provided with three thrust jacks or rams 44 which can supply an axial force in either direction. Also, each anchor collar 42 is provided with three wall gripper extension jacks 46 which, when extended, force wall gripper pads 48 into engagement with the bore wall. Wall gripper jacks 46 are trunnion mounted to structural braces 47 such that jacks 46 may pivot when extending. Guides 49 prevent the movable gripper pads 48 from becoming misaligned during operation. Thus, with an anchor collar 42 jacked into the bore and anchored to the bore wall, there is provided means for jacking from the anchor collar in either axial direction.

The wall gripped pads 48 of the anchor collars are hydraulically activated when anchor to the mine bore wall is required. (The anchor release from the mine bore wall is also hydraulically activated). The thrust jacks or rams 44 are also hydraulically operated.

Anchor collars 42 are preferably constructed of steel.

The leading edges of the wall anchor collar, extending with the longitudinal axis of each segment, will advantageously have an inward taper. This provides a means for removing loose material (mine flakings) between the mating telescopic ends of the wall anchor collar and the adjacent concrete support collar. Without the tapered edge, this material could be disposed to a compressive action during the telescoping movement between the two collars when jacking pressures are applied to the "string" of collars.

After a number of support collars 32 have been jacked into the bore and the drive stem 20 properly extended, an anchor collar 42 is placed into alignment with the bore utilizing device 14 and jacked into the bore as mining proceeds. One purpose of anchor collar 42 is, as its name implies, to form an anchor into the wall of the bore from which to continue jacking. Several more support collars 32 are next jacked into the bore and are followed by another anchor collar 42. The number of support collars 32 jacked into the bore between anchor collars 42 depends on the jacking force required to force the string of support collars in or out of the bore. The jacking force can be determined by measuring the pressure required to operate the jacks.

By reversing the jacking procedure all of the jacking, support and anchor collars 18, 32 and 42 can be removed from the bore for reuse. This reverse jacking procedure is also related to the well-known "inch-worming method" previously referred to herein. Removal of the collars is very important since the present invention provides means for extending the bore several thousand feet into the mineral deposit. Thus, recovery of collars 18, 32 and 42 is critical to the economy of the method. As the collars are being removed from the mine, the mining head, drive stem and probe hole metal encasement can be pulled from the bore by pressure exerted at the mine portal.

This recovery of the mining apparatus in accordance with the present invention can suitably be effected commencing with the jacking out of the mine of the support collar or collars nearest the mine portal. These support collars are pushed toward the mine portal by the thrust jacks of the anchor collar located interiorly to them in the bore. This anchor collar and the support collar or collars interior to it can then be pushed toward the portal by the next inner anchor collar, and so on for the remainder of the collars in the bore. The innermost anchor collar, located directly behind the mining head, is pushed toward the portal by the mining head, as the latter is being pulled from the bore. This sequence of steps can be repeated as many times as necessary until all mining apparatus has been removed from the bore.

This novel process for recovering mining apparatus should, as a normal procedure, be initiated as soon as the bore has reached the optimum depth in order to minimize the effect of earth subsidence or the "closing in" on the bore from all directions. This subsidence, or movement of the earth due to the pressure being altered by removing a portion of the strata, usually occurs over a period of weeks or months while completion of the bore and removal of the collars should be completed in a matter of days.

The energy system to the mobile mine support system (inch-worming technique) described above is hydraulic. Its power plant 14 is positioned at the portal. It can be designed to move a string of collars extending several thousand feet in length, at select rates ranging, for example, from one foot to over 30 feet per hour.

It can be easily understood that the method described herein can be used to mine both horizontal and pitched seams. Also the method can be used to mine seams which do not outcrop. Thus the "heading" or "face" may be underground. Such an underground heading would require additional handling of all components but is well within the scope of the method described herein.

The present invention provides a highly satisfactory method for the mining of coal from pitching seams. Techniques which permit this are currently extremely limited and are most often uneconomical. The present invention constitutes a remote controlled and/or surface based mining method, which is capable of mining seams ranging to over 30 feet in thickness; mining up to 80% or more of the coal deposit in a seam; mining gaseous deposits of coal safely and without exposure of manpower to hazard; recovering methane from gaseous deposits; and achieving substantial savings in mining costs. Higher costs will be encountered in mining seams less than 12 feet thick. In these seams, the method of the invention is especially suitable for mining metallurgical coal and can extend to seam structures ranging down to approximately 18 inches in diameter.

It is recognized that the United States has vast reserves of coal to meet its future energy requirements, but techniques to mine a great portion of these reserves safely and economically have not been developed. The present invention constitutes a unique method of mining these coal reserves, with many advantageous features. It provides a way to increase current production with surface based underground mechanized mining systems, strongly oriented to safety. Not only does the method have the capability of recovering up to and over 80% of the coal in a given deposit, but it also has the exceptional merit that highly gaseous coal reserves can be mined and the methane can be recovered during the mining operation. The method can further be harnessed to supply part or all of the energy supply required to sustain the mining operation. A limited amount of surface preparation for a mine site is required. Providing the proper air environment to an underground remote controlled operation is also seen to involve a lower cost burden than would be required for an air supply to miners working at or near the proximity of a heading.

As mentioned above, the invention provides a means to gas recovery from gaseous deposits of coal. This becomes feasible through the requirement of driving the probe hole axially through the center of the seam deposit. The probe hole, driven with drilling mud as the circulation media, allows for monitoring and logging the gas pressure and the locations of high yield. A partial exhaust of the gas can be effected during the probe hole drilling operation, with recovery from the circulating mud system. Continued exhaust and capture of the released gas can be planned as the full bore mining operation progresses, either through the mining machine's mining head and the drive stem, or through an exhaust system designed to drain the annulus of the mine bore and positioned at the portal. The technology involved in the gas recovery, such as packer systems, and flow induction and collector systems, is found in the oil well drilling and construction (tunnelling) fields.

Miners can go down the shaft between the outer surface of the drive shaft and the inner surface of the collars to get to the mining head to replace cutters as they wear out. This activity is not possible in the conventional auger type mining operation since the auger completely fills the bore hole.

While there has been illustrated and described a preferred embodiment of the invention, this is set forth in illustration of this invention and not as limitation of this invention. It will be apparent to those skilled in the art that changes may be made in the materials and procedures described without departing from the scope of the invention as set forth in the appended claims.

I claim:

1. A method for continuously mining a mineral deposit without requiring miners to enter said mineral deposit comprising:

(a) drilling a pilot hole through said mineral deposit;

(b) encasing said pilot hole with a metal casing;

(c) boring out a shaft in said mineral deposit, said shaft having a substantially circular cross section, by means of a rotary mining head with a rotary hollow drive stem, said drive stem having conveyor flights in a helical pattern, said conveyor flights being attached to and protruding from the inside surface of said drive stem, and said rotary mining head being both forced into said mineral deposit and rotated by means of said drive stem;

(d) using said metal casing to guide said rotary mining head in its boring operation;

(e) removing the borings through said hollow drive stem; and (f) jacking into said shaft means for preventing collapse thereof, said hollow drive stem being rotatably supported within said means for preventing collapse of said shaft by support means mounted on said means for preventing collapse of said shaft.

2. The method of claim 1 wherein said means for preventing collapse of the shaft comprises support collars located inside said shaft from behind said rotary mining head to the mine portal.

3. The method of claim 2 wherein said drive stem is supported on rollers housed in said support collars.

4. The method of claims 2 or 3 wherein the means for preventing collapse of the shaft additionally comprises (a) an anchor collar located directly behind the mining head, said anchor collar being equipped with (i) means to support the drive stem, (ii) means to grip the wall of the shaft, and (iii) means to jack forward said mining head and to jack rearward the support collars located exteriorly to it in the shaft, and (b) additional anchor collars interspaced at intervals between said support collars, each of said additional anchor collars being equipped with (i) means to support the drive stem, (ii) means to grip the wall of the shaft, and (iii) means to jack forward the support collars located interiorly to it in the shaft and to jack rearward the support collars located exteriorly to it in the shaft.

5. The method of claim 1 which includes load cells for sensing the pressure between said rotary mining head and said means for preventing collapse of the shaft and for controlling the jacking of said means for preventing collapse of the shaft into said shaft.

6. The method of claim 1 which includes the additional step of removing from said shaft said means for preventing collapse thereof and said mining head, drive stem, and metal casing after completion of the mining operation.

7. The method of claim 6 wherein said means for preventing collapse of said shaft comprises a system of support and anchor collars wherein (a) an anchor collar is located directly adjacent the mining head, said anchor collar being equipped with (i) means to support the drive stem, (ii) means to grip the wall of the shaft, and (iii) means to jack forward said mining head and to jack rearward the support collars located exteriorly to it in the shaft, and (b) support collars are located from behind said anchor collar to the mine portal, said support collars being equipped with means to support the drive stem, and (c) additional anchor collars are interspaced at intervals between said support collars, each of said additional anchor collars being equipped with (i) means to support the drive stem, (ii) means to grip the wall of the shaft, and (iii) means to jack forward the support collars located interiorly to it in the shaft and to jack rearward the support collars located exteriorly to it in the shaft.

8. The method of claim 7 wherein said means for preventing collapse of said shaft are jacked out of said shaft.

9. The method of claim 8 which includes load cells for sensing the pressure between the rotary mining head and the means for preventing collapse of the shaft and for controlling the jacking of said means for preventing collapse of the shaft into and out of said shaft.

10. The method of claims 8 or 9 wherein the drive stem is supported on rollers housed in the support and anchor collars.

11. The method of claim 10 wherein the additional step of removing from the shaft the means for preventing collapse thereof, mining head, drive stem and metal casing comprises;

(a) pushing toward the mine portal the support collars nearest said mine portal by the anchor collar located interiorly to said support collars in said shaft;

(b) pushing toward the mine portal the anchor collar of above step (a) and the support collars located interiorly to it in said shaft by the next inner anchor collar located interiorly to the latter support collars in said shaft to thereby position said anchor collar of about step (a) for again pushing toward the mine portal the support collars of above step (a) which remain in said shaft;

(c) repeating above step (b) for (i) said next inner anchor collar and each succeeding anchor collar having interiorly located support collars and for (ii) said interiorly located support collars; and (d) pulling toward the mine portal the mining head, drive stem and metal casing, whereby the anchor collar located directly behind the mining head is pushed toward the mine portal by said mining head;

said steps (a) to (d) being repeated until all mining apparatus is removed from the shaft.

12. The method of claim 4 wherein said drive stem is supported on rollers housed in said anchor collars.

13. The method of claim 5 wherein said means for preventing collapse of the shaft comprises support collars located inside said shaft from behind said rotary mining head to the mine portal and said drive stem is supported on rollers housed in said support collars.

14. The method of claim 13 wherein the means for preventing collapse of the shaft additionally comprises (a) an anchor collar located directly behind the mining head, said anchor collar being equipped with
(i) means to support the drive stem,
(ii) means to grip the wall of the shaft, and
(iii) means to jack forward said mining head and to jack rearward the support collars located exteriorly to it in the shaft, and (b) additional anchor collars interspaced at intervals between said support collars, each of said additional anchor collars being equipped with
(i) means to support the drive stem,
(ii) means to grip the wall of the shaft, and
(iii) means to jack forward the support collars located interiorly to it in the shaft and to jack rearward the support collars located exteriorly to it in the shaft.

15. The method of claim 14 wherein said drive stem is supported on rollers housed in said anchor collars.

16. The method of claim 1 wherein said rotary mining head comprises:

(a) a bulkhead with a front and rear side;

(b) cutting means mounted on the front side of said bulkhead;

(c) openings adjacent said cutting means and extending through said bulkhead from said front side to said rear side, said bulkhead openings being sized to allow passage therethrough of only the quantity of mined material which said drive stem conveyor flights are capable of removing;

(d) a frusto-conical shaped enclosure having a rear opening and attached to the rear side of said bulkheads; and (e) helically shaped conveyor flights attached to the interior of said frusto-conical shaped enclosure and extending from the rear side of said bulkhead through said rear opening of said frusto-conical shaped enclosure.

17. The method of claim 16 wherein said means for preventing collapse of the shaft comprises support collars located inside said shaft from behind said rotary mining head to the mine portal and said drive stem is supported on rollers housed in said support collars.

18. The method of claim 17 wherein the means for preventing collapse of the shaft additionally comprises (a) an anchor collar located directly behind the mining head, said anchor collar being equipped with
(i) means to support the drive stem,
(ii) means to grip the wall of the shaft, and
(iii) means to jack forward said mining head and to jack rearward the support collars located exteriorly to it in the shaft, and (b) additional anchor collars interspaced at intervals between said support collars, each of said additional anchor collars being equipped with
(i) means to support the drive stem,
(ii) means to grip the wall of the shaft, and
(iii) means to jack forward the support collars located interiorly to it in the shaft and to jack rearward the support collars located exteriorly to it in the shaft.

19. The method of claim 18 wherein said drive stem is supported on rollers housed in said anchor collars.

20. The method of claim 19 which includes the additional step of removing from said shaft said means for preventing collapse thereof and said mining head, drive stem, and metal casing after completion of the mining operation.

21. The method of claim 20 which includes load cells for sensing the pressure between the rotary mining head and the means for preventing collapse of the shaft and for controlling the movement of said means for preventing collapse of the shaft into and out of said shaft.

22. The method of claim 1 which includes the additional step of recovering gas from said mineral deposit through said pilot hole and/or said shaft.

23. A rotary mining head adapted to be moved and rotated by a drive stem which has interiorly mounted conveyor flights for removal of mined material, said mining head comprising:

(a) a bulkhead with a front and rear side;

(b) cutting means mounted on the front side of said bulkhead;

(c) openings adjacent said cutting means and extending through said bulkhead from said front side to said rear side, said bulkhead openings being sized to allow passage therethrough of only the quantity of mined material which said drive stem conveyor flights are capable of removing;

(d) a frusto-conical shaped enclosure having a rear opening and attached to the rear side of said bulkhead; and (e) helically shaped conveyor flights attached to the interior of said frusto-conical shaped enclosure and extending from the rear side of said bulkhead through said rear opening of said frusto-conical shaped enclosure.

24. The rotary mining head of claim 23 wherein said cutting means comprise adjacently mounted rotary disc cutters and scalper teeth and wherein said bulkhead openings are adjacent said scalper teeth.

25. In combination with a metal encasement of a probe hole, a rotary mining head with a bushing at its center of rotation, said bushing surrounding said metal encasement of said probe hole whereby said mining head is guided by said probe hole encasement, and a rotary drive stem, said drive stem having conveyor flights in a helical pattern, said conveyor flights being attached to and protruding from the inside surface of said drive stem, and said mining head being adapted to be both moved into and out of a mineral deposit surrounding said probe hole and rotated by said drive stem.

26. The apparatus of claim 25 wherein said mining head additionally comprises (a) a bulkhead with a front and rear side;

(b) cutting means mounted on the front side of said bulkhead;

(c) openings adjacent said cutting means and extending through said bulkhead from said front side to said rear side, said bulkhead openings being sized to allow passage therethrough of only the quantity of mined material which said drive stem conveyor flights are capable of removing;

(d) a frusto-conical shaped enclosure having a rear opening and attached to the rear side of said bulkhead; and (e) helically shaped conveyor flights attached to the interior of said frusto-conical shaped enclosure and extending from the rear side of said bulkhead through said rear opening of said frusto-conical shaped enclosure.

27. The apparatus of claim 26 which additionally comprises support means for said drive stem, said drive stem support means comprising a system of mine support collars equipped with stabilizer rollers for rotatably supporting said drive stem.

28. The apparatus of claim 27 wherein said system of mine support collars comprises (a) an anchor collar located directly adjacent the mining head, said anchor collar being equipped with (i) stabilizer rollers to support the drive stem, (ii) means to grip the wall of a mine shaft, and (iii) means to jack forward said mining head and to jack rearward the support collars located exteriorly to it in the shaft, (b) support collars located from behind said anchor collar to the mine portal, said support collars being equipped with stabilizer rollers to support the drive stem, and (c) additional anchor collars interspaced at intervals between said support collars, each of said additional anchor collars being equipped with (i) stabilizer rollers to support the drive stem, (ii) means to grip the wall of the shaft, and (iii) means to jack forward the support collars located interiorly to it in the shaft and to jack rearward the support collars located exteriorly to it in the shaft.

29. The apparatus of claim 27 which includes load cells for sensing the pressure between said mining head and said mine support collars and for controlling the movement of said support collars into and out of the mine.

30. In combination with a rotary mining head and a conveyor for removing mined material, the improvement which comprises a rotary bulkhead, said bulkhead having openings sized to allow passage of only the quantity of mined material which said conveyor is capable of removing, and a conveyor, said conveyor comprising a rotary drive stem, said drive stem having conveyor flights in a helical pattern, said conveyor flights being attached to and protruding from the inside surface of said drive stem, and said mining head being adapted to be both moved into and out of a mineral deposit and rotated by said drive stem.

31. The apparatus of claim 30 wherein said mining head additionally comprises a frusto-conical shaped enclosure having a rear opening and attached to the rear side of said bulkhead; and helically shaped conveyor flights attached to the interior of said frusto-conical shaped enclosure and extending from the rear side of said bulkhead through said rear opening of said frusto-conical shaped encloure.

32. The apparatus of claim 31 which additionally comprises support means for said drive stem, said drive stem support means comprising a system of mine support collars equipped with stabilizer rollers.

33. The apparatus of claim 32 wherein said system of mine support collars comprises (a) an anchor collar located directly adjacent the mining head, said anchor collar being equipped with (i) stabilizer rollers to support the drive stem, (ii) means to grip the wall of a mine shaft, and (iii) means to jack forward said mining head and to jack rearward the support collars located exteriorly to it in the shaft (b) support collars located from behind said anchor collar to the mine portal, said support collars being equipped with stabilizer rollers to support the drive stem, and (c) additional anchor collars interspaced at intervals between said support collars, each of said additional anchor collars being equipped with (i) stabilizer rollers to support the drive stem, (ii) means to grip the wall of the shaft, and (iii) means to jack forward the support collars located interiorly to it in the shaft and to jack rearward the support collars located exteriorly to it in the shaft.

34. The apparatus of claim 33 which includes load cells for sensing the pressure between said mining head and said mine support collars and for controlling the movement of said support collars into and out of the mine.

* * * * *